US007438656B2

(12) United States Patent
Davis et al.

(10) Patent No.: US 7,438,656 B2
(45) Date of Patent: Oct. 21, 2008

(54) LAMINATED BLANK FOR MACHINING INTO A BAT

(76) Inventors: Marc Christian Davis, 6736 Lakeview Ter., Hickory, NC (US) 28601; Walter Dennis Davis, 32 Crestview St., Granite Falls, NC (US) 28630; Wallace Jay Davis, 3083 Spencer Trail, Lenoir, NC (US) 28645

( * ) Notice: Subject to any disclaimer, the term of this patent is extended or adjusted under 35 U.S.C. 154(b) by 0 days.

(21) Appl. No.: 11/673,635

(22) Filed: Feb. 12, 2007

(65) Prior Publication Data

US 2007/0135246 A1 Jun. 14, 2007

Related U.S. Application Data

(62) Division of application No. 10/606,987, filed on Jun. 26, 2003.

(51) Int. Cl.
*A63B 59/06* (2006.01)

(52) U.S. Cl. ..... 473/564; 473/567

(58) Field of Classification Search ..... 473/564–568, 473/519, 520, 457; 428/106, 218
See application file for complete search history.

(56) References Cited

U.S. PATENT DOCUMENTS

| | | | | | |
|---|---|---|---|---|---|
| 813,400 | A * | 2/1906 | Buehler | 473/564 |
| 1,601,915 | A * | 10/1926 | Hillerich | 473/564 |
| 1,706,680 | A * | 3/1929 | Smith | 473/564 |
| 4,572,508 | A * | 2/1986 | You | 473/520 |
| 4,689,257 | A * | 8/1987 | Baum | 428/106 |
| 4,714,251 | A * | 12/1987 | Cook | 473/564 |
| 5,490,669 | A * | 2/1996 | Smart | 473/564 |
| 5,620,179 | A * | 4/1997 | MacKay, Jr. | 473/564 |
| 5,944,938 | A * | 8/1999 | Winterowd et al. | 156/315 |
| 6,007,440 | A * | 12/1999 | Bender et al. | 473/564 |
| 6,010,417 | A * | 1/2000 | Young et al. | 473/564 |
| 2004/0029660 | A1 * | 2/2004 | Chen et al. | 473/564 |
| 2006/0030437 | A1 * | 2/2006 | Bao et al. | 473/564 |

* cited by examiner

*Primary Examiner*—Mark S Graham
(74) *Attorney, Agent, or Firm*—Monty Simmons; Simmons Patents

(57) ABSTRACT

The present technology relates to laminated ball bats and a methodology for making the same. The disclosed technology provides for a laminated blank suitable for machining into a laminated bat having a generic bat shape (such as a bat consisting of a handle and a barrel where the handle has a smaller diameter than the barrel) that offers greater flexibility in changing the bat's weight distribution. Using lamination technology, various portions of a blank may be constructed having different densities (and associated weights) thereby decoupling such blank's length/weight properties. Such technology provides a method of positioning a bat's center of mass (CM) at various locations along the bat thereby changing the location of the bat's sweet spot zone center. Bats constructed in accordance with the disclosed technology may have a variety of pre-selected weight distributions while maintaining a particular bat shape and a particular overall bat weight.

15 Claims, 14 Drawing Sheets

LAMINATED BLANK FOR MACHINING INTO A BAT

CLAIM TO PRIORITY

This application is a divisional of application Ser. No. 10/606,987, filed Jun. 26, 2003, the entire contents of which are incorporated herein by reference.

FIELD OF THE INVENTION

The present technology relates to laminated ball bats and a methodology for making the same.

BACKGROUND OF THE INVENTION

The confrontation between batter and pitcher has been the inspiration for numerous epic tales in baseball lore. Notably, in such confrontations, the pitcher usually wins. However, in professional baseball, a batter with a success rate of one hit out of every three times at bat (0.333 batting average) will likely be inducted into the Baseball Hall of Fame.

A batter's task is basically one of timing and the pitcher's task is to disrupt such timing. A quick review of exemplary timing that is associated with hitting a baseball provides insight to the challenges that batters face in this classic confrontation. First, a 90 mph fastball travels 60.5 feet (the distance between the pitcher and batter) in 0.46 seconds. Second, a swing requires on average 0.15 seconds, which gives the batter about 0.3 seconds to observe the pitch, process the observed information, and decide if and how to swing the bat. Third, if the pitcher has thrown a "breaking ball," about one-half of the break occurs in the last 0.1 seconds.

To disrupt a batter's timing, a pitcher may vary several pitched ball parameters. The pitcher my throw a curve ball, a knuckle ball, a slider, a screw ball or a fast ball. The pitcher may combine such variety of pitched ball types with throwing a high ball, a low ball, an inside ball or an outside ball. In response to such diversity of possible pitched ball types, a batter must leverage every possible advantage in attempting to hit a baseball.

In the above described confrontation, the batter's main tool is, of course, the bat. To enhance a batter's chances of hitting a baseball in light of the above described variety of pitching tactics, a batter may wish to have access to a variety of bat designs. One tactic a batter may employ is to use bats having different weight distributions. For example, a batter may wish to use a bat having a particular weight distribution when bunting and a bat having a different weight distribution when attempting to hit a home run. Restated, a batter may wish have access to bats having a variety of weight distributions so that the batter can use a bat having a particular weight distribution that will most likely transfer maximum energy from the bat to the ball based on the batter's anticipated swing and the ball's anticipated trajectory. In addition, the batter may wish to have access to such a variety of bat weight distributions while maintaining a desired bat shape and a desired overall bat weight.

Baseball bats have a well known conventional bat shape consisting of a handle end and a barrel end wherein the barrel end has a larger diameter than the handle end. Traditional solid wood bats have been in use for years and offer little opportunity for varying the weight distribution of the bat without varying the bat shape.

Another type of bat is a laminated bat. As used in this patent, the term "lamination" simply refers to layers of material stacked on top of one another with adjacent layers bonded together with a bonding agent to create an object larger than each of the separate individual layers. Examples of laminated bat designs are disclosed in U.S. Pat. No. 2,793,859 issued to Darling et al., U.S. Pat. No. 5,490,669 issued to Smart and U.S. Pat. No. 5,620,179 issued to MacKay, Jr., and such disclosures are incorporated herein by these references for all purposes.

OBJECTS AND BRIEF SUMMARY OF THE INVENTION

It is a principal object of the present invention to provide solid laminated bats having the well-known handle/barrel shape, but with a variety of pre-selected weight distributions. It is another principal object of the present invention to provide such bats having a variety of weight distributions while maintaining a particular shape and a particular overall weight for the bat. The disclosed technology provides for a bat that is designed with a generic bat shape (such as a bat consisting of a handle and a barrel where the handle has a smaller diameter than the barrel) that offers greater flexibility in changing the bat's weight distribution.

It also is a principal object of the present invention to provide a method of making a bat that will enable a bat's weight distribution to be varied so as to optimize the energy transfer to the ball based on the way the batter anticipates that the bat will be swung and the way the batter anticipates that the pitcher will throw the pitch.

Additional objects and advantages of the invention will be set forth in part in the description that follows, and in part will be obvious from the description, or may be learned by practice of the invention. The objects and advantages of the invention may be realized and attained by means of the instrumentalities and combinations particularly pointed out in the appended claims.

In accordance with one exemplary embodiment of the present technology, a laminated ball bat has an elongated body and an outer surface that is defined by the exterior outline of the bat. Such elongated body includes a handle on one end and a barrel on the opposite end. In between the barrel and the handle may be a label section that connects the handle to the barrel. The bat is preferably composed of a plurality of bat portions, each bat portion being composed of a plurality of thin strips. For this presently preferred embodiment, the bat is preferably composed of at least two distinct portions. The first bat portion is preferably composed of a first plurality of thin strips. Each thin strip defines a pair of opposed faces wherein each face defines a substantially flat plane with each plane preferably being substantially parallel to the other. Each thin strip further defines a peripheral edge connecting the opposed faces and defining a first section of the exterior outline of the bat. In addition, at least one face of one of such thin strips is bonded to a face of an adjacently disposed thin strip such that the peripheral edges of said pair of adjacently disposed and bonded thin strips form a section of the uninterrupted exterior outline of the bat. Such first plurality of bonded together thin strips defines a first portion of the bat.

The second bat portion is preferably composed of a second plurality of thin strips. Each thin strip defines a pair of opposed faces wherein each face defines a substantially flat plane with each plane preferably being substantially parallel to the other. Each thin strip further defines a peripheral edge connecting the opposed faces and defining a section of the exterior outline of the bat. In addition, at least one face of one of such thin strip is bonded to a face of an adjacently disposed thin strip such that the peripheral edges of said pair of adjacently disposed and bonded thin strips form a section of the uninterrupted exterior outline of the bat. Such second plurality of bonded together thin strips defines a second portion of the bat.

A face of one of the thin strips of the first portion of the bat may be bonded to a face of one of the thin strips of the second portion of the bat so as to join the first portion to the second portion. In an alternative embodiment, the first portion of the bat may be bonded to a face of a bat portion other than the second portion of the bat. Preferably, the density of the first portion of the bat is substantially uniform, and the density of the second portion of the bat is substantially uniform. Moreover, the density of the first portion of the bat preferably differs from the density of the second portion of the bat. Additionally, while the volumes occupied by the first and second portions can be equal in some embodiments of the bat, the volumes occupied by the first and second portions also can be different in some embodiments of the bat.

The thin strips in each of the first and second plurality of thin strips have a preferred thickness (defined as the shortest distance between the opposed faces of each thin strip) between about 0.00787 inches to about 0.375 inches. The above-described faces may be bonded together by a bonding agent such as an urea resin formulated with a powdered catalyst. Another suitable bonding agent includes a type 1 waterproof glue formulated with a powdered catalyst. A sealant and/or a catalyzed lacquer protectant may be applied over the outer surface of the bat to seal and protect the bat. The thin strips may be composed of cellulosic materials such as maple, mahogany, ash, cherry, poplar, gum, tupelo and pine. The thin strips may also be composed of fiber reinforced composites, such as carbon and Kevlar (trade name) veneer. Examples of such technologies are disclosed in U.S. Pat. No. 4,533,589 issued to Sewell and such disclosure is incorporated herein by reference for all purposes.

Additional embodiments of the present subject matter concern methodology for making a laminated ball bat. In one exemplary embodiment of such methodology, a first step is to provide a first laminated block composed of a plurality of successively adjacent thin strips wherein adjacent thin strips are bonded together by a bonding agent. A second step is to provide a second laminated block. The volume and density of the first block may be different from the volume and density of the second block. The second laminated block is also composed of a plurality of successively adjacent thin strips wherein adjacent thin strips are bonded together by a bonding agent.

In the next step, the first laminated block is bonded to the second laminated block to form a laminated blank. Such laminated blank is put into a hydraulic press, and about 100-psi to about 250-psi of pressure is applied to the laminated blank. The laminated blank is kept under pressure until the bonding agent has sufficiently cured, thereby forming a cured laminated blank. The time required for the curing process may be about 2 days. However, the time required for the curing process may be shortened by using radio frequency energy to heat the laminated blank during the curing process. The cured laminated blank is then machined to form an elongated body disposed about a longitudinally extending axis. The machining of this body produces an outer surface defined by the exterior outline of a bat. The body includes a handle on one end and a barrel on the opposite end. The body may include a label section connected between the handle and the barrel.

Additional embodiments of the subject technology, not necessarily expressed in this summarized section, may include and incorporate various combinations of aspects of features, parts, or steps referenced in the summarized objectives above, and/or other features, parts, or steps as otherwise discussed in this application. Thus, the scope of the presently disclosed technology should in no way be limited to any particular embodiment.

Those of ordinary skill in the art will better appreciate the features and aspects of such embodiments, and others, upon review of the remainder of the specification.

BRIEF DESCRIPTION OF THE DRAWINGS

The accompanying drawings, which are incorporated in and constitute a part of the specification, illustrate at least one presently preferred embodiment of the invention as well as some alternative embodiments. These drawings together with the description, serve to explain the principles of the invention but by no means are intended to be exhaustive of all of the possible manifestations of the invention.

Figure 1:
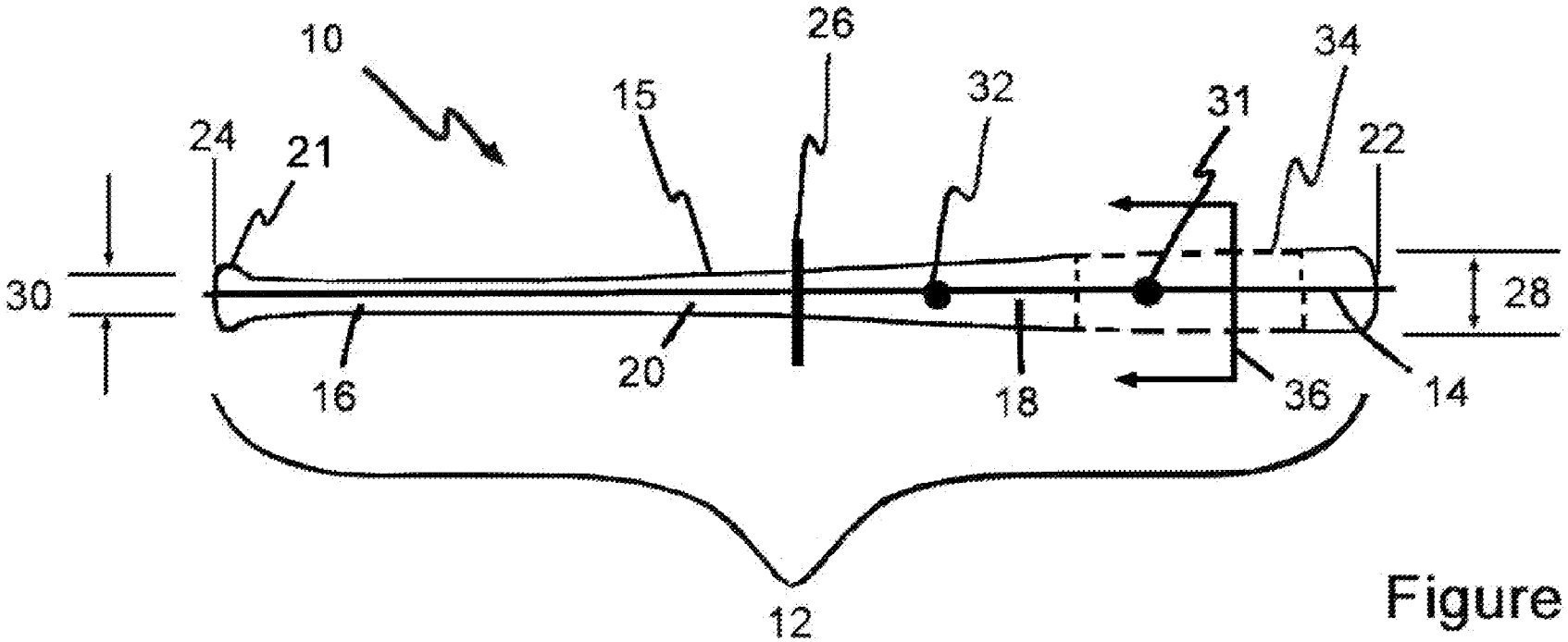
FIG. 1 is a side plan view of an exemplary laminated bat in accordance with the present subject matter.

Repeat use of reference characters in the present specification and drawings is intended to represent same or analogous features or elements of the disclosed technology.

DETAILED DESCRIPTION OF EXEMPLARY EMBODIMENTS

The present technology relates to a laminated bat and a methodology for making the same. A bat designed according to the present invention takes full advantage of lamination technology by using a plurality of materials, such as veneer made from various composite materials and/or wood types having varying densities (and corresponding weights) to provide the bat designer with more choices concerning the relationship between the shape of the bat, the length of the bat, the weight of the bat, and the weight distribution of the bat. Such technology allows for a variety of improved bat designs by affording the bat designer more control over the location of the bat's center of mass (defined later) and thus over the desired weight distribution. Moreover, the present technology provides the ability to vary the bat's weight distribution without affecting the shape of the bat or the overall weight of the bat. The present technology allows the location of wood of greater density in the portions of the bat that are anticipated to contact the ball during the batter's intended swing at desired pitches to hit. Such technology allows for a bat design that is better tailored to the batter's specifications.

It should be noted that while the exemplary embodiments are directed to a baseball bat design, the same technology may be used to construct other types of bats. In addition, the exemplary embodiments presented and discussed herein should not insinuate limitations of the present subject matter. Features illustrated or described as part of one embodiment may be used in combination with aspects of another embodiment to yield yet further embodiments. Additionally, certain features may be interchanged with similar devices or features not expressly mentioned which perform the same or similar function. Reference will now be made in detail to the presently preferred embodiments of the subject technology. The same numerals are assigned to the same components throughout the drawings and description.

FIG. 1 shows one exemplary embodiment of a bat having a generally optimized shape and generally designated by the numeral (10). Exemplary bat (10) has an elongated body (12) disposed symmetrically about a longitudinally extending central axis (14). Bat (10) has an outer surface (15) that is defined by the exterior outline of the bat. Such elongated body (12) preferably includes a handle (16) on one end and a barrel (18) on the opposite end. The handle (16) is where the batter would grasp the bat (10) with his/her hands and typically terminates in a knob (21) at the free end (24) of the handle (16). The knob (21) has a larger diameter than the maximum diameter (30) of the handle (16). In between the handle (16) and the barrel (18) may be a label section (20) that connects the handle (16) to the barrel (18). The bat's length is the distance between the free end (22) of the barrel (18) and the free end (24) of the handle (16). The bat has a geometric center plane (26) located midway between barrel end (22) and handle end (24) and perpendicular to the central axis (14). The bat's barrel (18) has a maximum diameter (28) that is larger than the maximum diameter (30) of the handle (16).

The "center of mass" (CM) of a body is generally defined as that point of such body which moves as though the body's total mass existed at the point if one assumes that all external forces were applied at that point. By definition, a balanced bat's CM is located at the bat's geometric center (the middle point between the two ends of such bat). As shown in FIG. 1, for example, if bat (10) were 30 inches long, bat (10) would have a geometric center that is the center point of the center plane (26) located 15 inches from either end of the bat. If the CM of such a bat is also located 15 inches from either end of the bat, such a bat is said to be balanced. The bat desirably has a center of mass (32) that is located between the geometric center plane (26) and the barrel end (22) for this present embodiment of bat (10).

For one exemplary embodiment, a barrel segment (34) defines a solid volume that is preferably composed of two distinct portions. Referring now to the cross-sectional view shown in FIG. 2, a first barrel portion (40) and a second barrel portion (42) of barrel segment (34) are shown from the perspective that is designated in FIG. 1 by arrows labeled by the numeral (36). First barrel portion (40) is preferably composed of a first plurality of thin strips (44*a*, 44*b*, 44*c*, 44*d*) wherein each thin strip (44*a*-44*d*) is composed of a first material. Such first material is preferably composed of cellulosic material such as wood veneer and may be oak, maple, mahogany, ash, cherry, poplar, gum, tupelo, pine or any other type of suitable wood veneer. Veneer is a particular type of thin wood strip typically ranging in thickness from about 0.20 millimeters (app. 1/127") to about 9.525 millimeters (app. 3/8"). Such first material may also be composed of a fiber reinforced composite material, such as carbon or Kevlar (trade name) composite with one or more of the aforementioned wood veneers.

Figure 2:
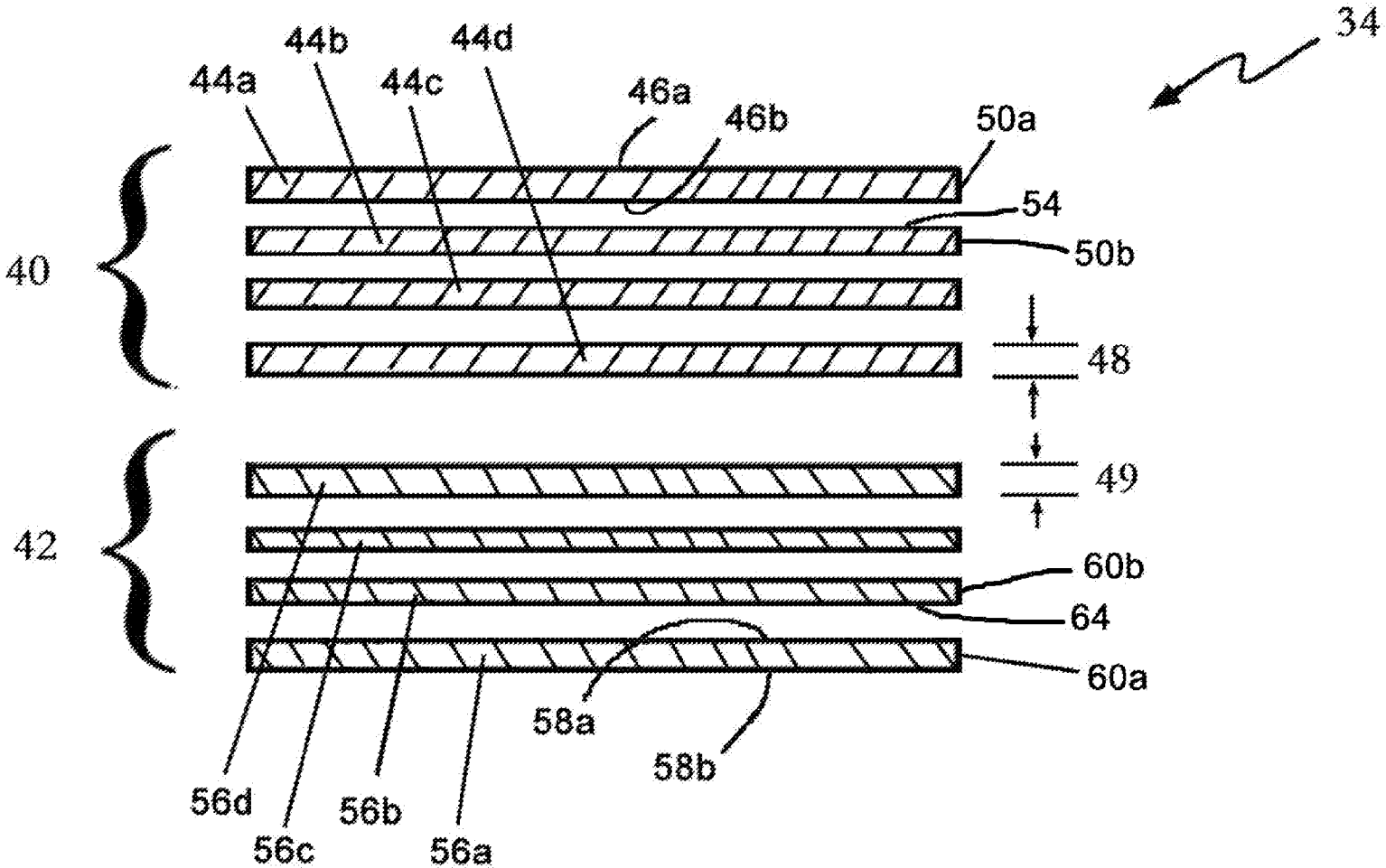
FIG. 2 is a disassembled cross-sectional view of two portions of bat segment (34), from perspective (36) as shown in FIG. 1, showing the individual thin strips that compose two portions (40), (42) of exemplary bat segment (34)

As schematically shown in FIG. 2, each thin strip (44*a*-44*d*) of the first plurality of thin strips has a presently preferred thickness (48) between about 0.00787 inches to about 0.375 inches. Notably, the thickness of each of the thin strips (44*a*-44*d*) is not required to be equal to the thickness of any of the others. However, in a presently preferred embodiment, all of the thicknesses are substantially the same and are 0.375 inches.

Each thin strip (44*a*, 44*b*, 44*c*, 44*d*) defines a pair of opposed faces wherein each face defines a substantially flat plane (not shown in FIG. 2) with each plane preferably being substantially parallel to the other. As shown in FIG. 2 for example, thin strip (44*a*) defines opposed faces (46*a*) and (46*b*). Face (46*a*) defines a substantially flat plane that is parallel to the substantially flat plane that defines opposed face (46*b*).

Figure 3:
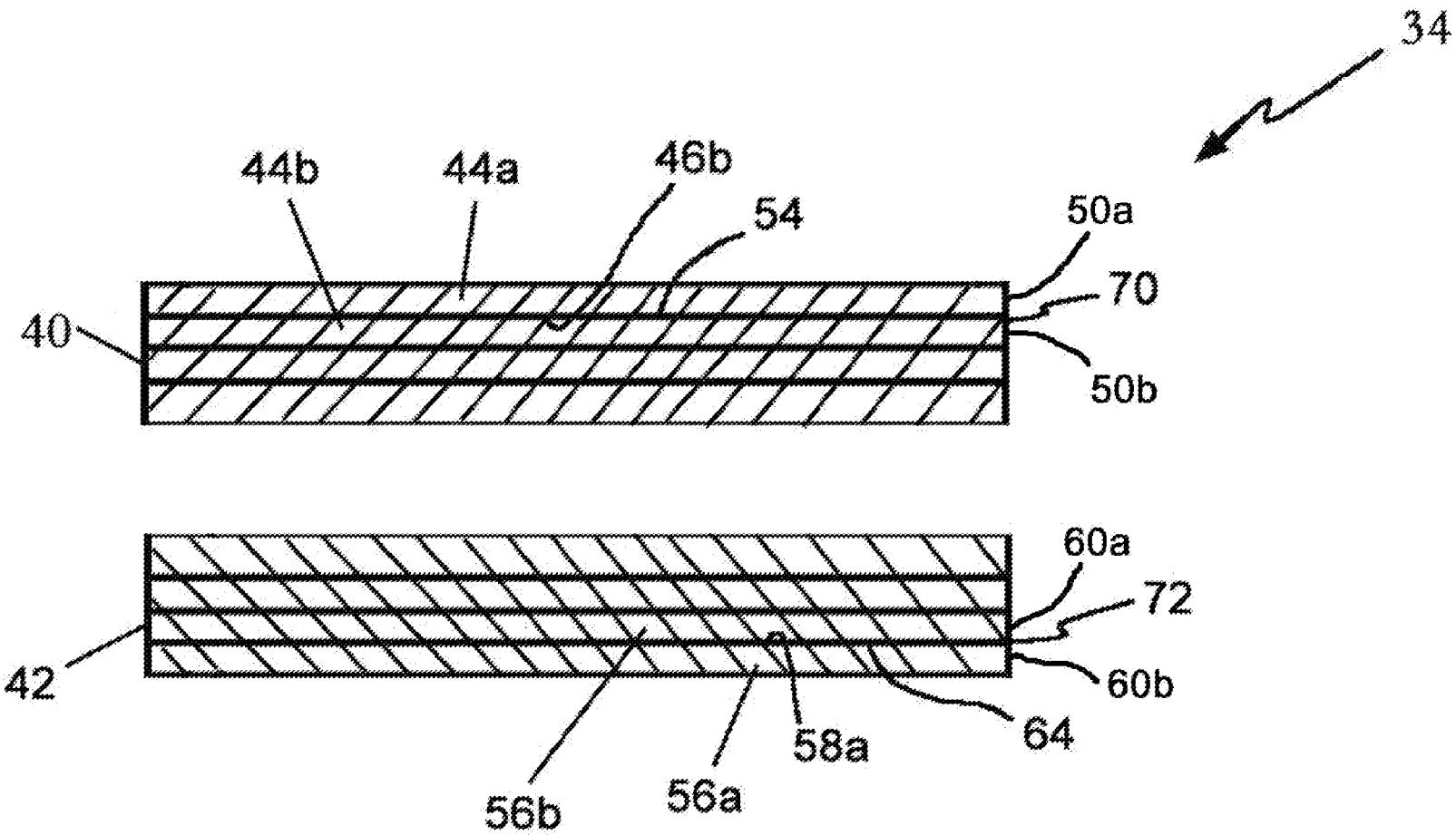
FIG. 3 is an assembled cross-sectional view of the bat portions (40), (42) of bat segment (34) shown in FIG. 2.

Each thin strip (44*a*-44*d*) further defines a peripheral edge connecting the opposed faces and defining a first section of the exterior outline of the barrel. For example, as shown in FIG. 2, thin strip (44*a*) defines a peripheral edge (50*a*), which forms a first section of the outer surface (15) (FIG. 1) of the bat (10). Similarly, thin strip (44*b*) defines a peripheral edge (50*b*), which forms another section of the outer surface (15) (FIG. 1) of the bat (10). In addition, at least one face of one of such thin strips is bonded to a face of an adjacently disposed thin strip such that the peripheral edges of said pair of adjacently disposed and bonded thin strips (and the layer of bonding agent disposed therebetween) form a larger section of the uninterrupted exterior outline of the barrel. As shown in FIG. 3, thin strip face (46*b*) of thin strip (44*a*) [shown in FIG. 2 and FIG. 3] is bonded to a thin strip face (54) of thin strip (44*b*). In so doing, the respective edges (50*a* and 50*b*) form a section (70) of the uninterrupted exterior outline (15) [as shown in FIG. 1] of the barrel (18).

Such thin strips may be bonded together, for example, using a bonding agent. One suitable bonding agent includes an urea resin formulated with a powdered catalyst. Another suitable bonding agent includes a type 1 waterproof glue formulated with a powdered catalyst. Such first plurality of bonded together thin strips defines a first portion, barrel portion (40), of the barrel segment (34).

Similarly, as schematically shown in FIG. 3, a second barrel portion (42) is preferably composed of a second plurality of thin strips (56*a*-56*d*). Each thin strip (56*a*-56*d*) may be composed of a second material. Such second material is preferably a celleousic material such as wood veneer and may be composed of maple, mahogany, ash, cherry, poplar, gum, tupelo, pine or any other type of suitable wood veneer. Such second material may also be composed of a fiber reinforced composite material, such as carbon or Kevlar (trade name) composite with one or more of the aforementioned wood veneers. In addition, each thin strip (56*a*-56*d*) has a preferred thickness (49) between about 0.00787 inches to about 0.375 inches. Notably, the thickness of each of the thin strips (56*a*-

56*d*) is not required to be equal to the thickness of any of the others. However, in a presently preferred embodiment, all of the thicknesses are substantially the same and measure 0.0625 ($1/16^{th}$) of an inch.

Each thin strip (56*a*-56*d*) defines a pair of opposed faces wherein each face defines a substantially flat plane (not shown in FIG. 3) with each plane preferably being substantially parallel to the other. See FIG. 5 for example. As shown in FIG. 2 for example, thin strip (56*a*) defines opposed faces (58*a*) and (58*b*). Face (58*a*) defines a substantially flat plane that is parallel to the substantially flat plane that defines opposed face (58*b*).

Each thin strip (56*a*-56*d*) further defines a peripheral edge connecting the opposed faces and defining a second section of the exterior outline of the barrel. For example, as shown in FIG. 2, thin strip (56*a*) defines a peripheral edge (60*a*), which forms a first section of the outer surface (15) (FIG. 1) of the bat (10). Similarly, thin strip (56*b*) defines a peripheral edge (60*b*), which forms another section of the outer surface (15) (FIG. 1) of the bat (10). In addition, at least one face of one of such thin strips is bonded to a face of an adjacently disposed thin strip such that the peripheral edges of said pair of adjacently disposed and bonded thin strips (and the layer of bonding agent disposed there between) form a section of the uninterrupted exterior outline of the barrel (18). For example, as shown in FIG. 3, thin strip face (58*a*) of thin strip (56*a*) is bonded to thin strip face (64) of thin strip (56*b*). In so doing, the respective edges (60*a*) and (60*b*) form a section (72) of the uninterrupted exterior outline (15) of the barrel (18).

Such thin strips may be bonded together, for example, using a bonding agent. One suitable bonding agent includes an urea resin formulated with a powdered catalyst. Another suitable bonding agent includes a type 1 waterproof glue formulated with a powdered catalyst. Such second plurality of bonded together thin strips defines a second portion, barrel portion (42), of the barrel segment (34).

A sealant and/or a catalyzed lacquer protectant my be applied in a continuous coating over the outer surface of above described bat (10) to seal and protect the bat from the intrusion of moisture that could change the density of the different portions (40), (42) for example.

Notably, for a presently preferred embodiment described above, each of the first and second barrel portions (40, 42) is the same size and adjacent to each other. It will be appreciated, however, that such barrel portions (40, 42) may run the length of the barrel or only part of the length of the barrel. In addition, such portions (40, 42) may be different in length and width and height, and such barrel portions (40, 42) may or may not be adjacent to each other. Additionally, such technology may be used to construct only non-barrel portions of bat (10), such as the handle section or the label section. And in some embodiments, each portion can be disposed in a different section (handle, label and barrel) than the other portion. In yet other embodiments, at least one portion can extend into two of the bat's sections (handle, label, barrel) while another portion can extend into the same two of the different sections or only one other section, either wholly or partially.

Similarly, for the presently preferred embodiment described above, the first barrel portion (40) is composed of successive layers of thin strips that are composed of one type of cellulosic material. It will be appreciated that such successive layers of thin strips may be composed of a plurality of cellulosic materials having varying densities without departing from the scope of this invention. The same is true for the successive layers of thin strips comprising barrel section (42).

Figure 4:
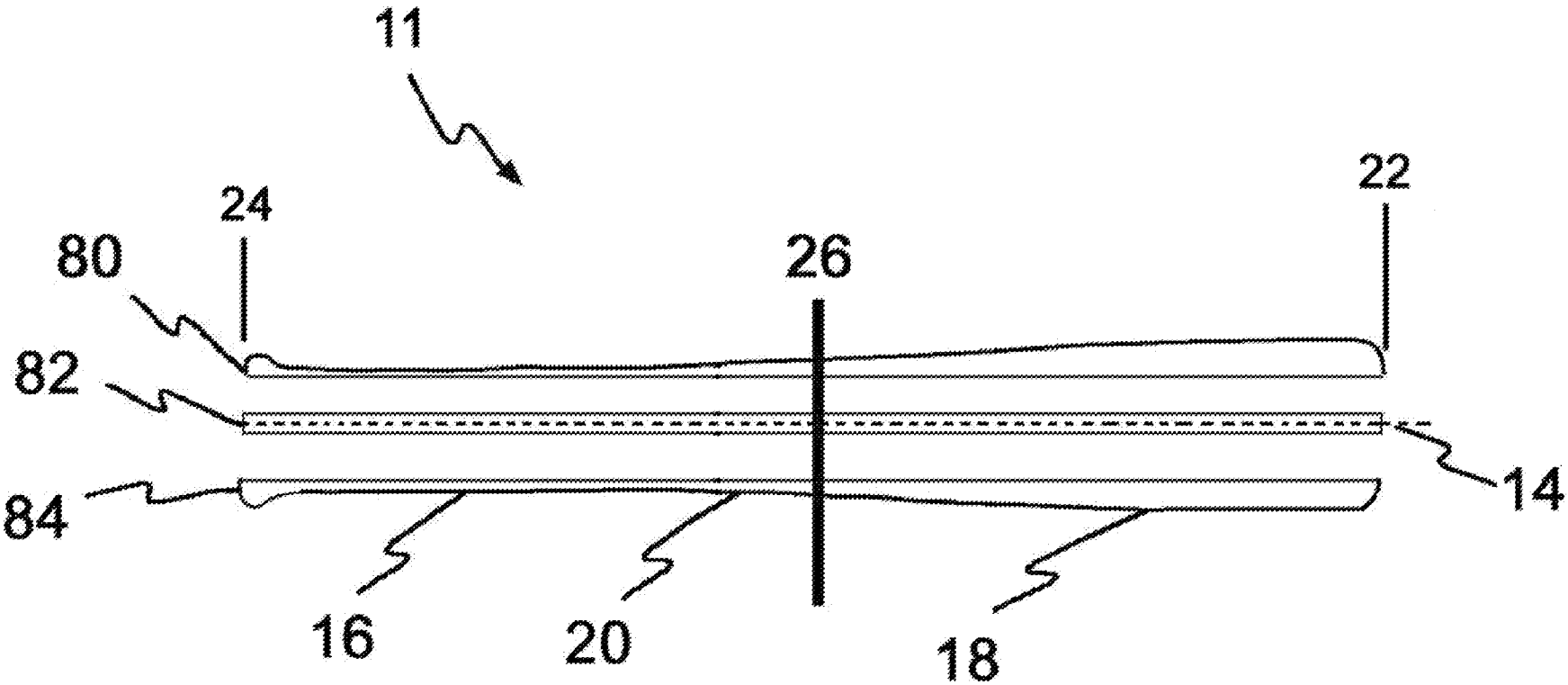
FIG. 4 is a side plan view of the assembly of major components of an exemplary laminated bat in accordance with one embodiment of the present subject matter.

Another presently preferred embodiment of a bat (11) in accordance with the present invention is shown in FIG. 4. As shown in FIG. 4, the laminated bat (11) is composed of three bat portions (80), (82) and (84). For the presently preferred embodiment shown in FIG. 4, each of bat portions (80), (82) and (84) is composed of a plurality of thin strips.

Figure 5:
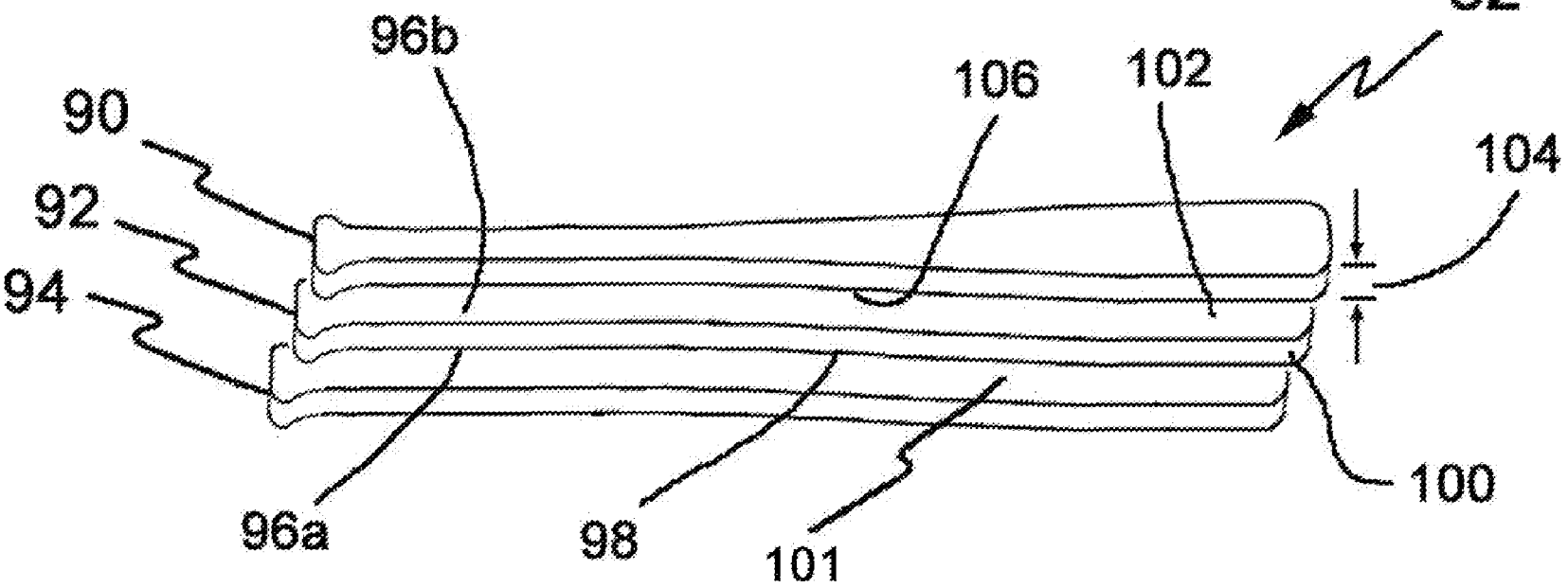
FIG. 5 is a disassembled perspective view showing three of the individual thin strips making up a bat portion (82) shown in FIG. 4.

FIG. 5 depicts a disassembled view of exemplary portion (82) comprising thin strips (90), (92) and (94). Each of thin strips (90), (92) and (94) of the first plurality of thin strips has a preferred thickness (104) between about 0.00787 inches to about 0.375 inches. In addition, each of thin wood strips (90), (92) and (94) is preferably composed of a celleousic material such as wood veneer made from maple, mahogany, ash, cherry, poplar, gum, tupelo, pine or any other type of suitable wood veneer. However, other materials such as composites of carbon and/or Kevlar and one or more of the aforementioned wood veneers may be used.

As shown schematically in FIG. 5 for example, each thin strip (90, 92, 94) defines a pair of opposed faces wherein each face defines a substantially flat plane. For example, thin strip (92) defines a pair of opposed faces (96*a*) and (96*b*) wherein opposed face (96*a*) defines a substantially flat plane (98) and opposed face (96*b*) defines substantially flat plane (102). Substantially flat planes (98) and (102) are connected by peripheral edge (100). Opposed face (96*a*) of thin strip (92) is preferably bonded to opposed face (101) of thin strip (94). Similarly, bat (11) portions (80) and (84) are constructed as described for bat portion (82). However, the outermost thin strip for each of second portion (80) and third portion (84) will be contoured on one face rather than formed as a flat plane.

As previously noted, for the presently preferred embodiment each of bat portions (80), (82) and (84) is composed of a plurality of thin strips with such thin strips being composed of a celleousic material. It will be appreciated that such successive layers of thin strips may be composed of a plurality of cellulosic materials having varying densities without departing from the scope of this invention. For example, referring to FIG. 5, thin strip (90) may be composed of cellulosic material CM1 having a density of X while thin strip (92) may be composed of cellulosic material CM2 having a density of Y, where Y is not equal to X.

It will be appreciated that while the preferred embodiment shown in FIG. 4 includes three bat portions, the disclosed technology may be used with only two bat portions or with three or more bat portions without departing from the scope of the present technology.

Figure 6A:
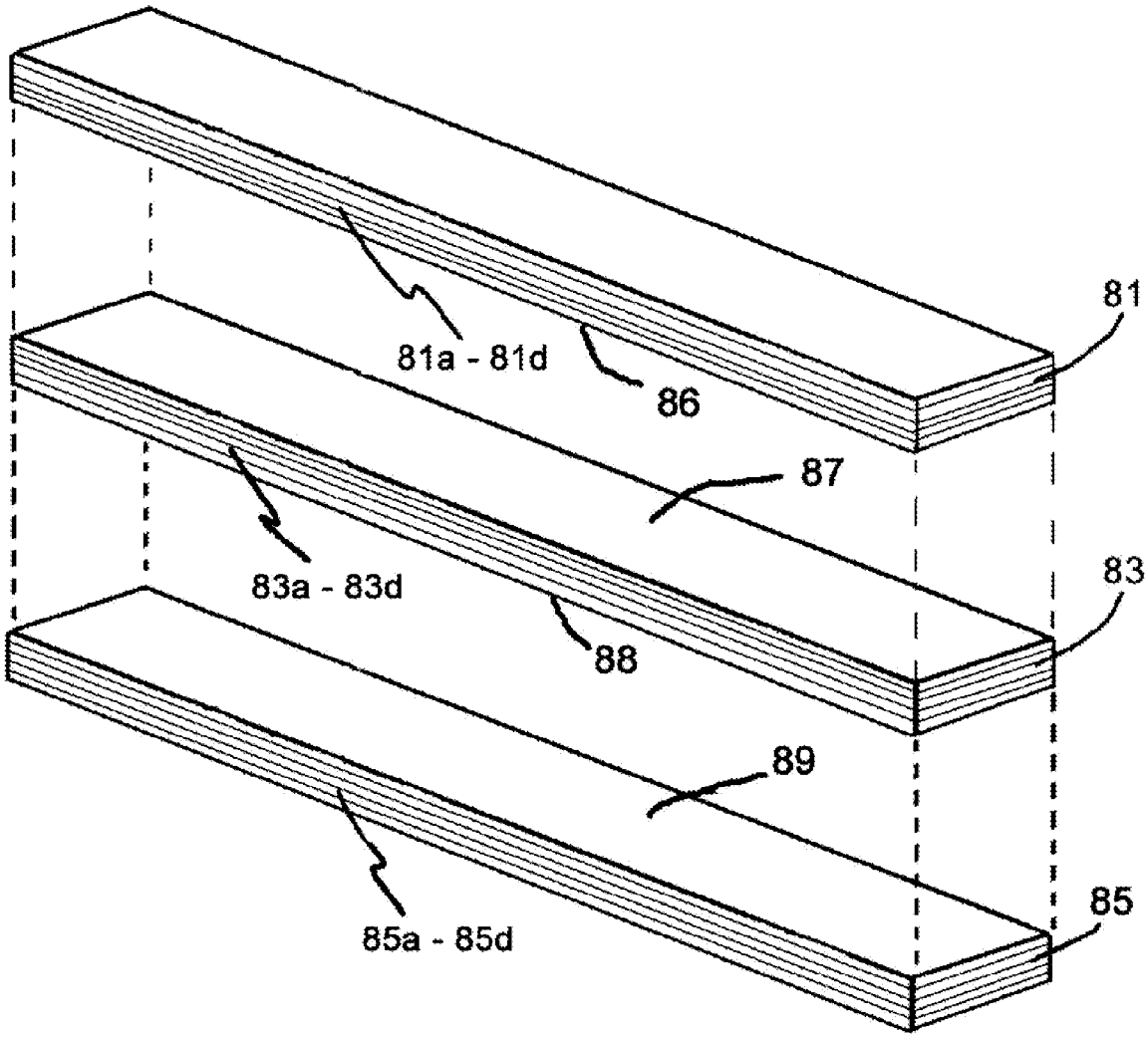
FIG. 6*a* is a disassembled perspective view showing three individual laminated blocks (81), (83), (85)
Figure 6B:
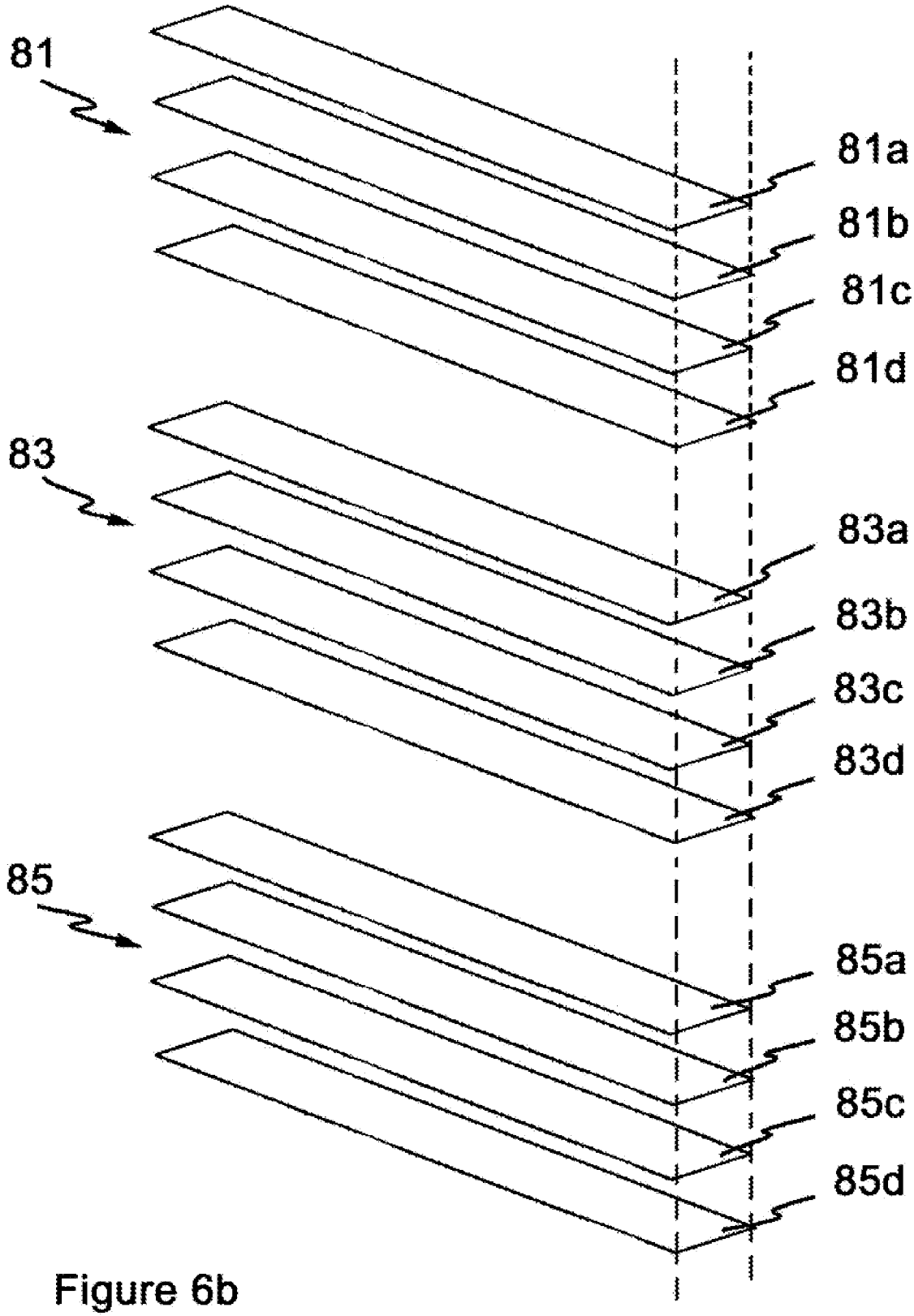
FIG. 6*b* is a disassembled perspective view schematically showing the successively adjacent thin strips making up the three individual laminated blocks in FIG. 6*a;*

One exemplary method for making a laminated ball bat according to the present technology is now considered. In this presently preferred method, one or more laminated blocks are formed. For example, three laminated blocks (81), (83) and (85) are provided in the illustrative embodiment that is shown in FIG. 6*a*. As shown in FIG. 6*b*, each of such laminated blocks (81), (83), (85) may be comprised respectively of a plurality of successively adjacent thin strips (81*a*-81*d*), (83*a*-83*d*) and (85*a*-85*d*). Successively adjacent thin strips (81*a*-81*d*), (83*a*-83*d*) and (85*a*-85*d*) have a preferred thickness of between about 0.00787 inches to about 0.375 inches and are bonded together by a bonding agent.

Preferably, in each block (81), the successively adjacent thin strips (81*a*-81*d*) are composed of the same type of cellulosic material CM1. Similarly, in block (83), successively adjacent thin strips (83*a*-83*d*) are all composed of the same type of cellulosic material CM2. In block (85), successively adjacent thin strips (85*a*-85*d*) are all composed of the same type of cellulosic material CM3. However, for the presently preferred method, the density (and corresponding weight) of at least one type of cellulosic material CM1, CM2 or CM3 is different from the other two.

Notably, while in the preferred method successively adjacent thin strips (81*a*-81*d*) are all composed of the same type of cellulosic material, CM1, it will be appreciated that different ones of such successively adjacent thin strips may be composed of any of a plurality of cellulosic materials without departing from the scope of this invention. The same is true for successively adjacent thin strips (83*a*-83*d*) and (85*a*-85*d*) in each of the other blocks (83), (85).

In accordance with the method, each laminated block is bonded to at least one of the other laminated blocks to form a laminated blank. Referring again to FIG. 6*a*, substantially flat plane (86) of laminated block (81) is bonded to substantially flat plane (87) of laminated block (83). Similarly, substantially flat plane (88) of laminated block (83) is bonded to substantially flat plane (89) of laminated block (85).

Figure 7:
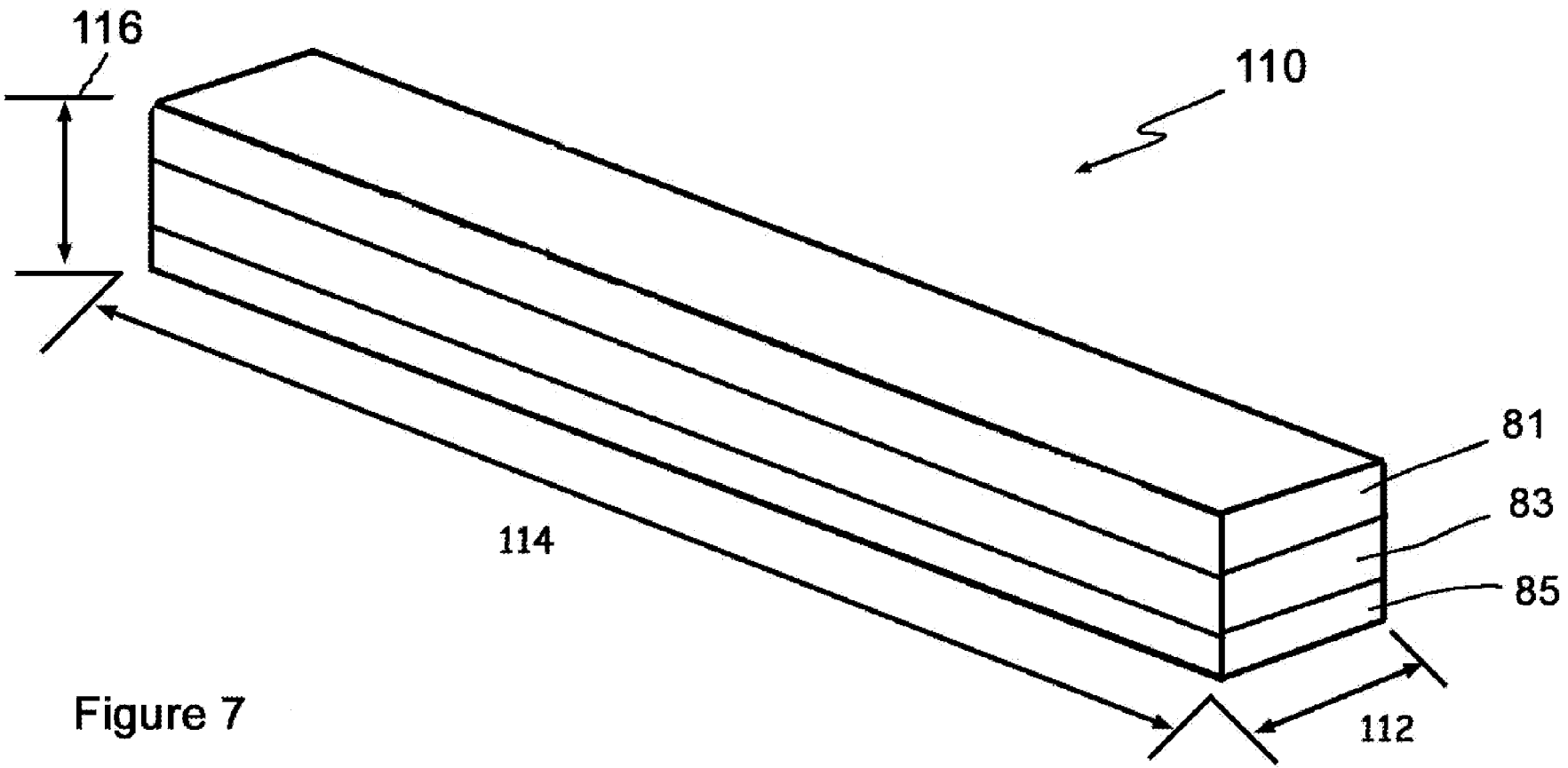
FIG. 7 is an assembled perspective view of a laminated blank composed of the three individual laminated blocks (81), (83), (85) shown in FIG. 6*a;*

Referring now to FIG. 7, laminated blank (110) is comprised of laminated blocks (81), (83) and (85). Laminated blank (110) is shown without depicting successively adjacent thin strips in FIG. 7. In this presently preferred method, laminated blank (110) is placed into a hydraulic press, which maintains the laminated blank (110) under pressure in a range between about 100 psi to about 250 psi until laminated blank (110) has cured. Typically, the pressure in this range is maintained on laminated blank (110) for about 2 days, although the laminated blank (110) may be kept under pressure for longer or shorter periods of times without departing from the scope of this method.

Figure 8:
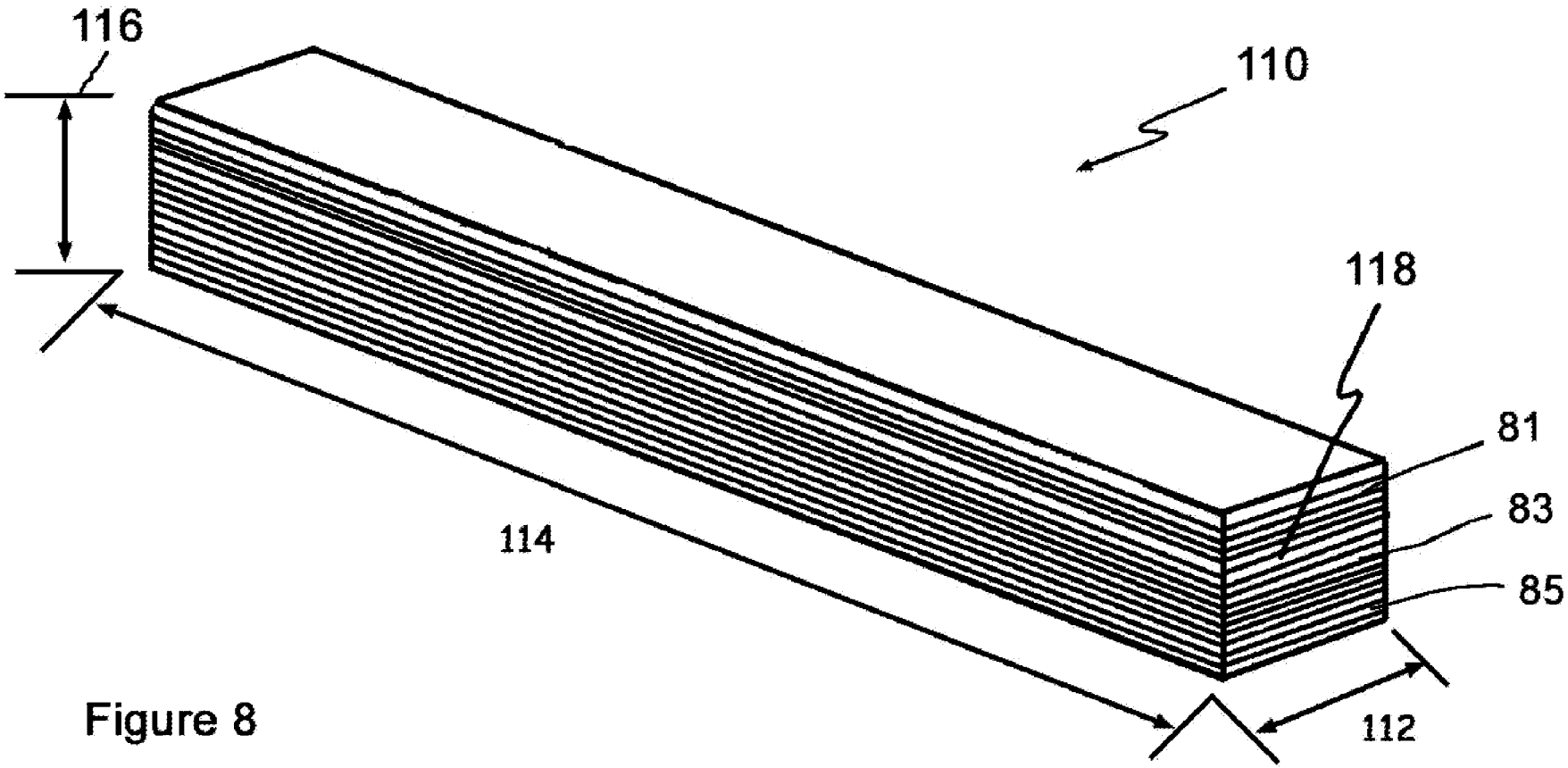
FIG. 8 is an assembled perspective view of a cured laminated blank.

The dimensions of the laminated blank are chosen so that they exceed the dimensions of the desired laminated bat. Referring now to FIG. 8, an exemplarily laminated blank (110) is depicted. Laminated blank (110) preferably has a length (114) that is slightly longer than the distance between barrel end (22) and handle end (24) of exemplary bat (10) shown in FIG. 1. Similarly, laminated blank (110) has a width (112) and a height (116) that is slightly longer than barrel diameter (28) of bat (10) shown in FIG. 1. Alternatively, laminated blank (110) may have a width (112) much wider than barrel diameter (28). For example, laminated blank (110) may have a width (112) that is about 10.5 times wider than the final desired barrel diameter (28). For such an example, after the curing process (described next), 10 cured laminated blanks having a width slightly wider than the final desired barrel diameter (28) could be obtained.

To accelerate the curing process, laminated blank (110) may be heated using radio frequency (RF) energy during the step of applying pressure to the laminated blank (110). For the presently preferred method, electromagnetic waves (radio frequency waves) vibrate molecules within the laminated blank (110) where such vibration causes friction, which in turn causes heat. The bonding agent responds by changing its molecular form, adhering to the wood and creating a bond. The term "cook time" is used to refer to the moments in time when radio waves are heating the bonding agent and laminated blank. Depending on the moisture level of the cellulosic material making up laminated blank (110), power levels of about 10 kilowatts to about 50 kilowatts are required to generate the required electromagnetic field strength. For example, for a desired cook time of about 25 minutes, a power level of about 20 kiloWatts is used heat a laminated blank (of sufficient volume to allow machining such laminated blank into one typical size baseball bat) composed of wood veneer strips having a moisture content of about 4 to 6% by weight. Other RF energy curing methods may be used without departing from the scope of the disclosed technology.

To minimize warping, laminated blank (110) may be kept under pressure while the laminated blank (110) cools. After laminated blank (110) has sufficiently cooled, laminated blank (110) may then be removed from the hydraulic press and allowed to cure an additional period of time (about 24 hours) before the machining process begins.

As noted above, for the presently preferred embodiment, the dimensions of the laminated blank are chosen so that they exceed the dimensions of the desired laminated bat. Referring now to FIG. 8, an exemplarily cured laminated blank (110) is depicted. Cured laminated blank (110) preferably has a length (114) that is slightly longer than the distance between barrel end (22) and handle end (24) of exemplary bat (10) shown in FIG. 1. Similarly, cured laminated blank (110) has a width (112) and a height (116) that is slightly longer than barrel diameter (28) of bat (10) shown in FIG. 1.

Figure 9B:
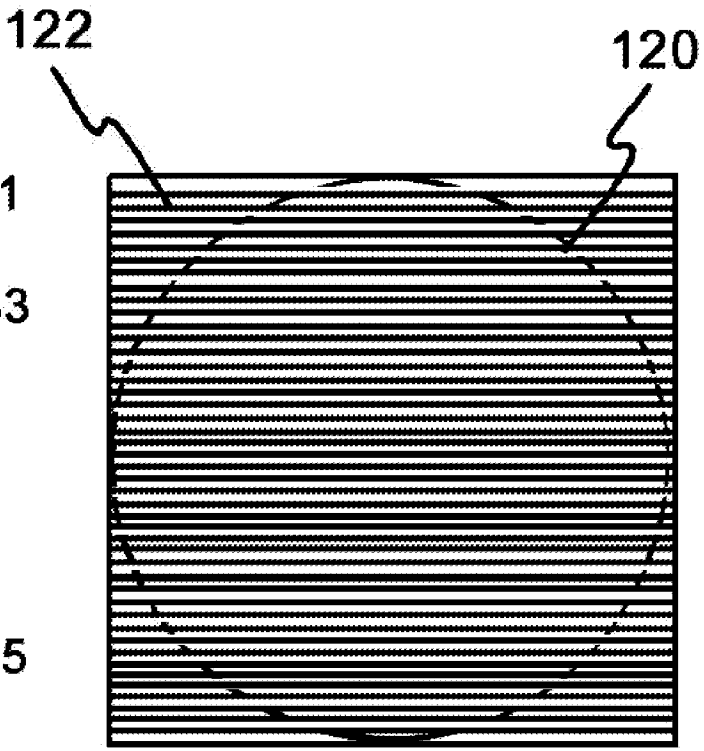
FIGS. 9*a* and 9*b* are cross-sectional views that schematically represent one end of the cured laminated blank shown in FIG. 8.
Figure 9A:
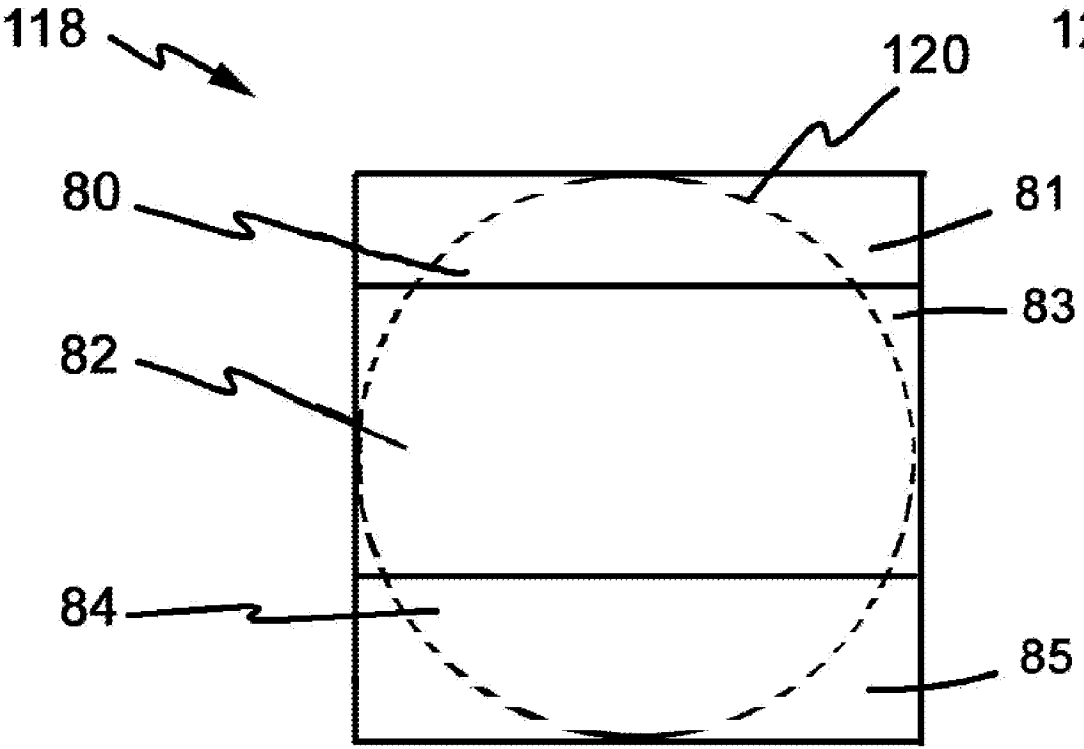

FIGS. 9*a* and 9*b* show an end view (118) of cured laminated blank (110). In FIG. 9*a*, laminated blocks (81), (83) and (85) are shown without showing successively adjacent thin strips (81*a*-81*d*), (83*a*-83*d*) and (85*a*-85*d*). Successively adjacent thin strips (81*a*-81*d*), (83*a*-83*d*) and (85*a*-85*d*) are shown in FIG. 9*b*. In FIGS. 9*a* and 9*b*, circle (120) schematically represents the final desired diameter (28) (FIG. 8) of barrel (18) for exemplary bat (10) shown in FIG. 1. By way of example, as shown in FIG. 9*a*, the region of cured laminated blank (110) within circle (120) become bat portions (80), (82) and (84), at barrel end (22) of exemplary bat (11) shown in FIG. 4, after the machining process (described next) has been completed.

Figure 12A:
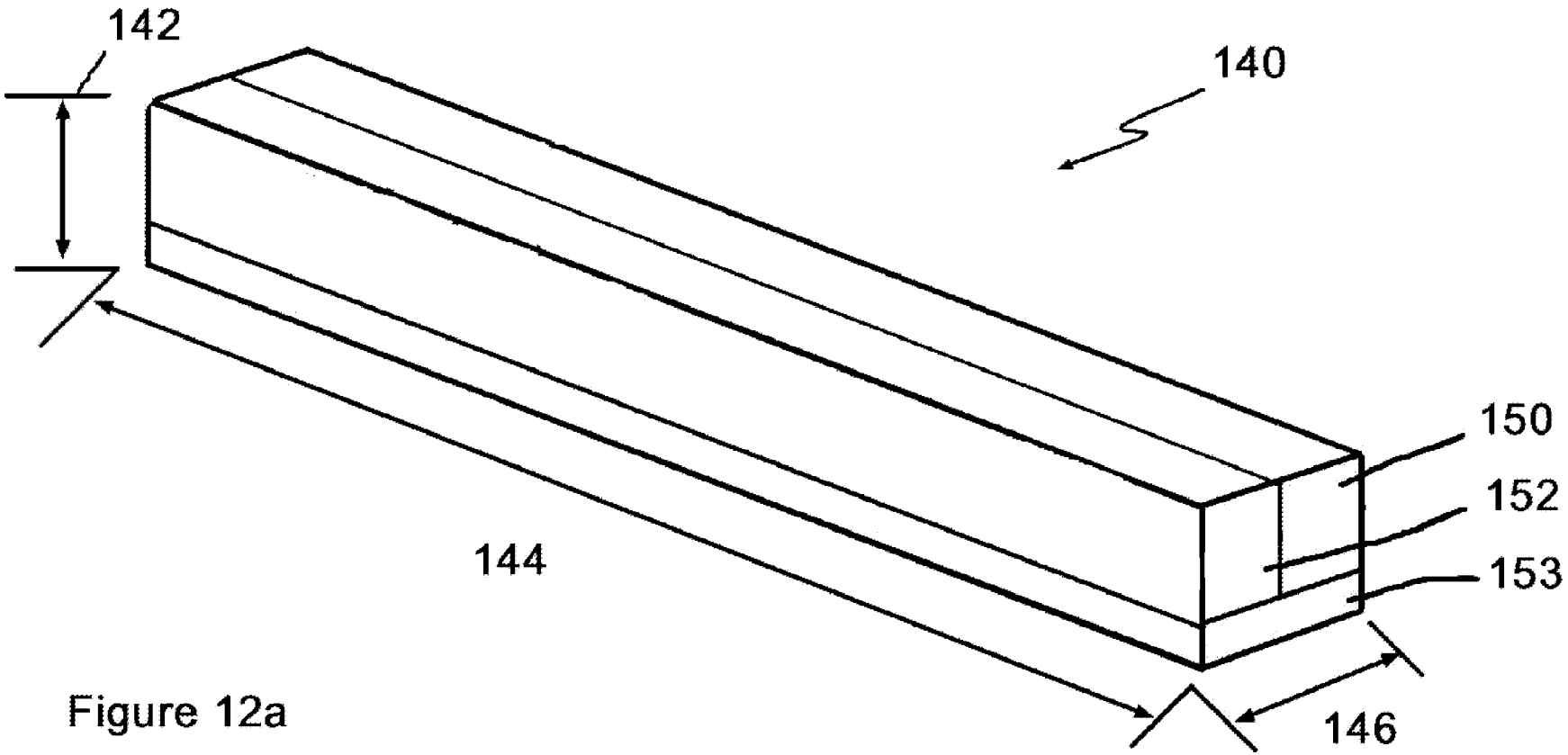
FIG. 12*a* is an assembled perspective view of a laminated blank composed of the three individual laminated blocks (150), (152), (153) with laminated block portions (150) and (152) disposed apart from each other.
Figure 12B:
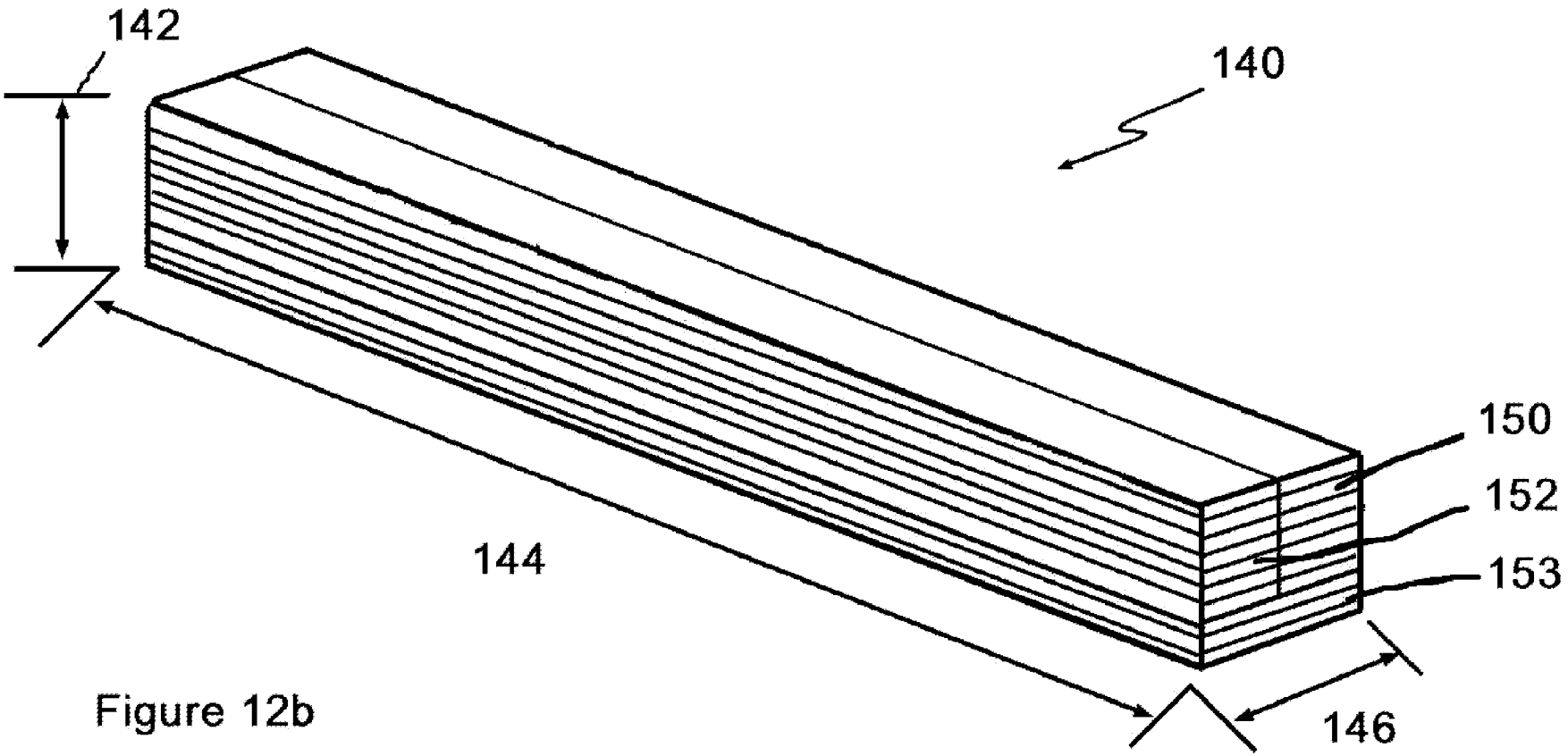
FIG. 12*b* is an assembled perspective view of the laminated blank shown in FIG. 12*a*.

Referring now to FIG. 12*a*, an alternative laminated blank configuration is depicted. Laminated blank (140) is comprised of laminated blocks (150), (152) and (153). Laminated blank (140) is shown in FIG. 12*a* without depicting successively adjacent thin strips. Such exemplarily laminated blank (140) preferably has a length (144) that is slightly longer than the distance between barrel end (22) and handle end (24) of exemplary bat (10) shown in FIG. 1. Similarly, laminated blank (140) has a width (146) and a height (142) that is slightly longer than barrel diameter (28) of bat (10) shown in FIG. 1. FIG. 12*b* shows laminated blank (140) and the successively adjacent thin strips comprising such laminated blank. Laminated blank (140) differs from laminated blank (110) in that bat sections (150) and (152) of laminated blank (140) are disposed apart from each other.

The next step in the presently preferred method is to machine cured laminated blank (110). Cured laminated blank (110) is machined to form an elongated body disposed about a longitudinally extending axis representing the approximate final desired bat shape defined by the exterior outline of a bat. The body includes a handle on one end and a barrel on the opposite end. The body includes a label section connected between the handle and the barrel. The machining is desirably performed by a lathe.

After machining laminated blank (110) to form a laminated bat, the machined laminated bat is sanded to its final shape. During such a sanding step the bat's shape and weight distribution may be fined tuned where necessary. After sanding the machined laminated bat, the exterior of such sanded and machined laminated bat may be sealed by applying a typical wood sealer. Such a sealed laminated bat may then be lightly sanded to remove rough areas. After lightly sanding the sealed laminated bat, a coat of catalyzed lacquer may be sprayed on the exterior surface of the bat to give such bat a finished luster and to harden the finish to help prevent scuff marks and chips.

Figure 10:
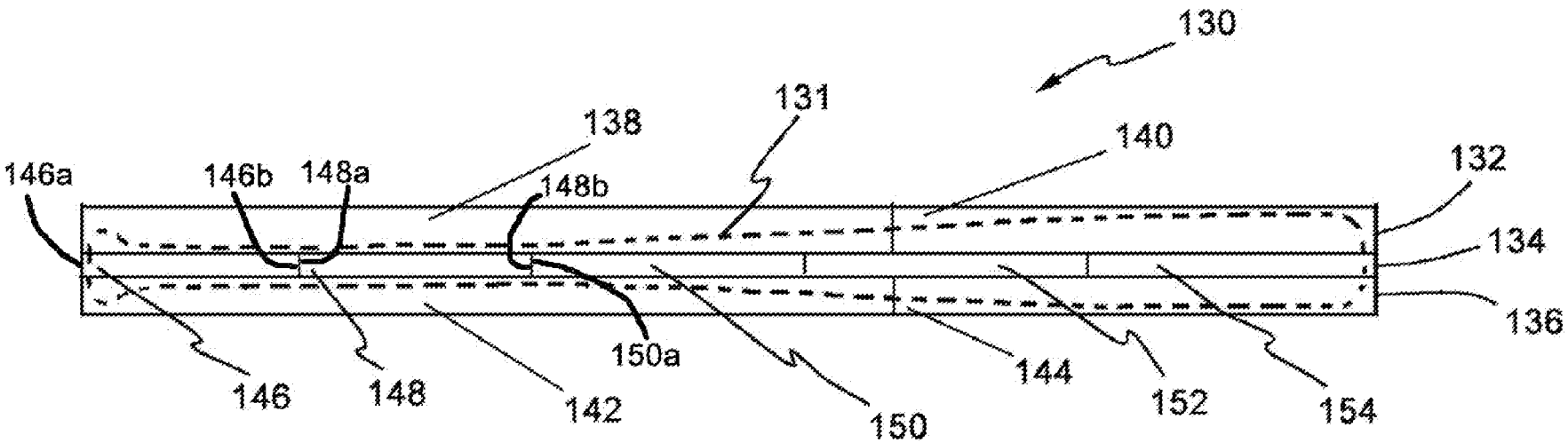
FIG. 10 is a side plan view of a laminated blank comprised of multiple laminated blocks.

Referring now to FIG. 10, an exemplary laminated blank (130) is depicted from a side plan view. The dashed line (131)

in FIG. 10 indicates the final shape of the bat. As shown in FIG. 10, laminated blank (130) is comprised of nine laminated blocks (138-154). As will be described below, having a laminated blank comprised of multiple laminated blocks enhances the ability to engineer the location of a bat's center of mass. It will be appreciated that with this exemplary embodiment, in addition to the faces of adjacent portions of each laminated block being bonded together, the ends of adjacent portions of laminated blocks are bonded together. For example, laminated block (146) includes laminated block end (146*a*) and (146*b*) and laminated block (148) includes laminated block end (148*a*) and (148*b*). Laminated block end (146*b*) is bonded to laminated block end (148*a*) and laminated block end (148*b*) is bonded to laminated block end (150*a*).

Varying Bat Weight Distribution

The flexibility of bat design using the above disclosed technology is now examined. The distance a hit ball travels depends on the hit ball speed, hit ball direction, hit ball rotation and the magnitude of the resistance to movement such hit ball experiences. For a given resistance (typically air resistance), the distance a baseball travels depends on three factors: (1) hit ball speed, (2) amount of spin and direction of spin on a hit ball, and (3) the angle a hit ball leaves the bat. Of these three factors, the bat design can affect (1) the hit ball speed and (2) the amount and direction of spin placed on a hit ball.

The speed of a hit baseball may be generally modeled using the following formula:

$$V_{HitBall} = \left[\frac{e-r}{1+r}\right]V_{PitchedBall} + \left[\frac{1+e}{1+r}\right]V_{Bat} \quad [1]$$

where $V_{HitBall}$=Hit Ball Speed, r=recoil value, e=Coefficient of Restitution (COR)

$V_{PitchedBall}$=Pitched Ball Speed, and $V_{BAT}$=Bat Swing Speed.

For r=0.25 and e=0.5, equation [1] reduces to:

$$V_{HitBall}=(0.2\times V_{PitchedBall})+(1.2\times V_{Bat}). \quad [2]$$

The coefficient of Restitution (COR) is the ratio of the relative bat-ball speed after the bat/ball collision compared to the relative bat-ball speed before the bat/ball collision. Equations [1] and [2] provide at least the following insights into the parameters that affect hit ball speed: (1) bat speed is far more important than the pitched ball speed, and (2) as bat recoil (r) increases, hit ball speed decreases.

It is axiomatic that a given batter can swing a lighter bat faster than a heavier bat. Thus, it may seem logical for batters to use the lightest bat possible (that could survive the bat/ball collision) when the goal is to achieve the greatest hit ball speed. However, as noted above, bat recoil (r) must also be considered. Restated, the inertial properties of a bat must be considered (i.e. a bat's weight (mass) and weight distribution) in a comprehensive evaluation of the parameters that affect the speed of a hit baseball.

The bat recoil value depends on inertial properties of the bat and the ball. As can be seen from equation [1] above, as a bat's recoil value (r) increases, the hit ball speed decreases. Bat recoil may be modeled using the following equation:

$$r=m/M_{eff} \quad [3]$$

where:

m=mass of the ball;

$M_{eff}$=effective mass of the bat;

Equation [3] may be rewritten as follows:

$$1/M_{eff}=r/m \quad [4]$$

The inverse of the effective bat mass ($1/M_{eff}$), allowing for conservation of angular momentum and linear momentum about the bat's CM, can also be modeled using the following equation:

$$1/M_{eff}=[1/M]+[(z)^2/I_{c.m.}] \quad [5]$$

where:

$M_{eff}$=effective mass of the bat;

M=actual mass of the bat;

z=the distance from the bat's CM to the bat/ball contact point;

$I_{c.m.}$=bat's moment of inertia about the bat's CM.

Substituting equation [4] into equation [5] yields the following equation:

$$r=[m/M]+[m(z)^2/I_{c.m.}] \quad [6]$$

From equation [5] and equation [6], it should be apparent that both the bat recoil value, r, and the effective mass of the bat ($M_{eff}$) will depend on the weight distribution of a bat and the location where the ball strikes such bat.

It will be appreciated that, as shown in FIG. 1, the CM of any bat is necessarily located at some distance from the barrel end (22) of a bat (10). In addition, for any pivoted bat (a bat being swung), bat speed is greatest at the barrel end (22) of the bat. Thus, a bat's CM is necessarily located at a point along a bat where bat speed is not maximized. Consequently, when selecting a bat/ball contact point that maximizes hit ball speed, there is a tradeoff between minimizing bat recoil (r), and maximizing bat speed. Restated, for a pivoted bat, a ball/bat contact point that minimizes bat recoil also results in a bat/ball contact point at a location of less than maximum bat speed. Similarly, a ball/bat contact point at a location of maximum bat speed (barrel end (22) of bat) also maximizes bat recoil (r).

From the above example, those of ordinary skill in the art would understand that the bat/ball contact point that maximizes hit ball speed is between the bat's CM and the barrel end (22) of the bat. Such a point along a bat where maximum hit ball speed is achieved is referred to as the center of the bat's "sweet spot zone." The sweet spot zone is generally defined as the area on a racket, club, bat, or paddle where hits are most effective. For a bat, the sweet spot zone is a region on the surface of a bat that is moving with a given momentum and most effectively transfers such momentum to a hit ball. More particularly, the sweet spot zone includes a point of contact (for a ball having a given trajectory and momentum) on the bat's surface that is moving with a moment of inertia and maximizes energy transfer from bat to ball.

Figure 11:
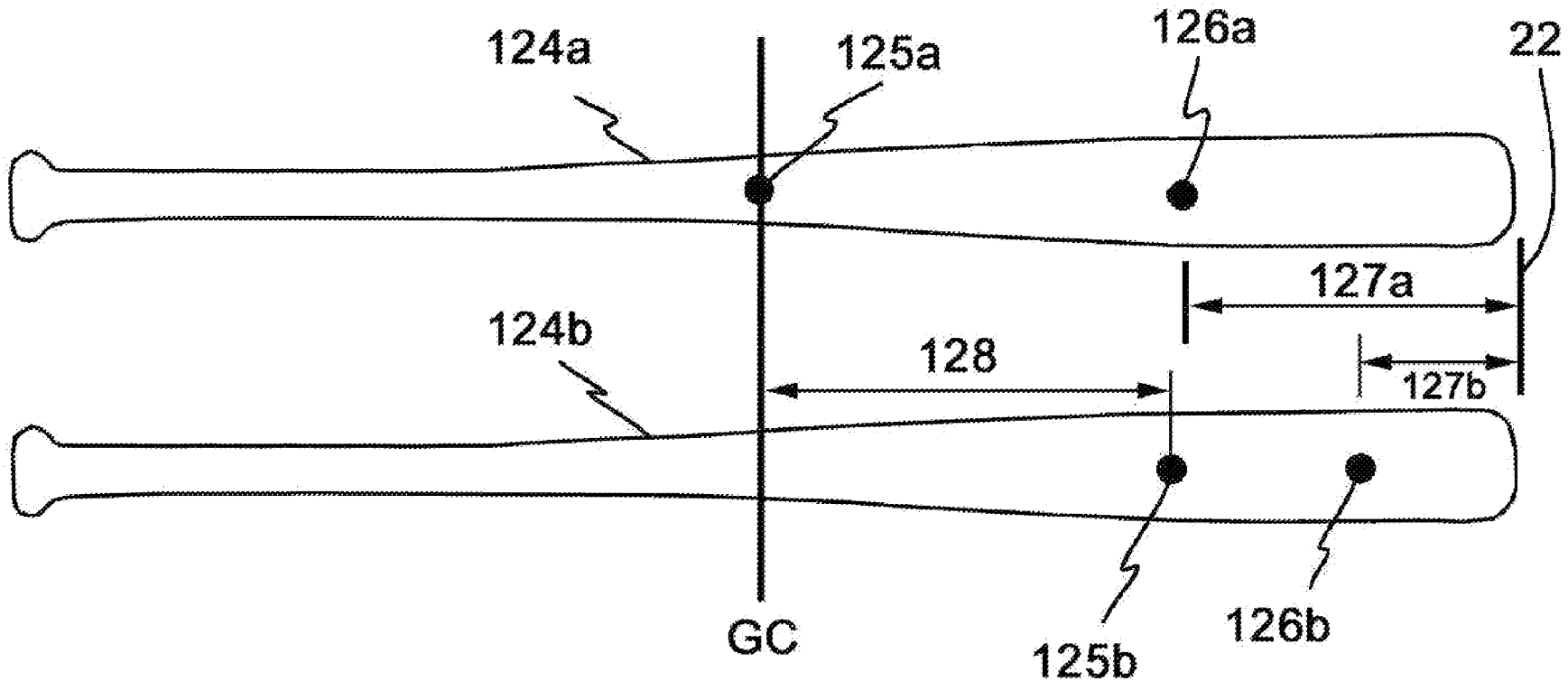
FIG. 11 is a side plan view of two exemplary laminated bats depicting two different weight distributions for such bats.

Referring now to FIG. 11, exemplary bats (124*a*) and (124*b*) are shown where bat (124*a*) and (124*b*) both weigh 28 ounces but have different weight distributions. Using a 32 inch overall bat length, bats (124*a*) and (124*b*) have a geometric center (GC) located 16.0 inches (32" divided by 2) from the barrel end (22) of the bat. For exemplary bat (124*a*), the CM (125*a*) coincides with the geometric center of the bat (i.e. the bat is perfectly balanced). For exemplary bat (124*b*), the CM (125*b*) is located 6 inches (128) from the bat's GC.

For exemplary bat (124*a*), the sweet spot zone center (126*a*) is located a distance (127*a*) from the barrel end (22) of the bat. For exemplary bat (124*b*), the sweet spot zone center (126*b*) is located a distance (127*b*) from the barrel end (22) of the bat. Notably, length (127*a*) is longer than length (127*b*) which in turn means that the sweet spot zone center (126*a*) of bat (124*a*) is located at a point of lower bat speed compared to the sweet spot zone center (126*b*) of bat (124*b*).

It will be appreciated that bat (124*a*) would be perfectly balanced, however, such bat's sweet spot zone center (126*a*) is located further from barrel end (22) than is the sweet spot zone center (126*b*) of bat (124*b*). Similarly, bat (124*b*) is not perfectly balanced, however, bat (124*b*) has a sweet spot zone center (126*b*) located closer to the barrel end (22) compared to bat (124*a*). Thus, while bat (124*a*) may be easier to control (swing) than bat (124*b*), a ball hit at the sweet spot zone center (126*a*) of bat (124*a*) would have a lower hit ball speed than a ball hit at the sweet spot zone center (126*b*) of bat (124*b*).

Conventional prior art solid wood bat designs afford little opportunity to vary the location of a bat's CM without altering the shape of the bat as the length/weight properties of conventional prior art solid wood bats are coupled. Such bats are often given specifications such as "L−3", where such a specification refers to the bat's length to weight ratio." For example, a 31 inch L−3 bat would weigh 28 ounces (31−3=28).

In contrast, using the disclosed technology to engineer the location of a bat's sweet spot zone, a variety of bats can be manufactured giving a batter a choice as to which bat attributes are more important based on such batter's anticipated swing and the pitcher's anticipated pitch. The disclosed technology decouples a bat's length/weight properties, thereby allowing the bat's CM to be positioned at various locations along the bat. Indeed, for bats constructed according to the disclosed technology, two bats complying with a "L−3" rating could have the same shape and have the same overall weight but have substantially different weight distributions (with different CM locations). To more fully characterize the weight distribution of the bat constructed according to the disclosed technology, a modified bat rating system may be required. One possible rating system would be "L−3−X" where x describes the location of the bat's CM from the bat's geometric center. For example, an exemplary 32 inch bat having a rating of "L−3+5" rating would weigh 29 ounces and have a CM located at 5 inches from the bat's geometric center or 11 inches from the barrel end of the bat.

Referring again to FIG. 10, by strategically selecting the cellulosic material making up the laminated blocks (138-154) of laminated blank (130), the CM of the bat can be positioned at different locations along the bat. For example, if one wishes to have a CM located as close as possible to the bat's barrel end, laminated blocks (140), (144) and (154) would be comprised of high density (heavy) cellulosic material relative to laminated blocks (138, 142, 146-152). Alternatively, one could select cellulosic material for laminated blocks (138-154) so as to create a bat having a CM located as close as possible to such bat's geometric center.

In addition to strategically selecting the cellulosic material making up the various bat portions, one can change the weight distribution by varying the shape of the bat. Such is accomplished by (1) varying the taper from the bat's barrel to the bats handle, (2) varying the diameter of the bat's handle, and (3) varying the shape of the bat's barrel. It is well known to those of ordinary skill in the art that when a batter hits a baseball, the contact time between the baseball and the baseball bat is typically around 1 millisecond (1/1000 of a second). Thus, during the moment of ball/bat contact, the batter's hands and the bat handle (16) barely move. Therefore, at the moment of energy transfer from the baseball bat to the baseball, a batter's grip, the size and shape of the bat handle (16), and other parameters far from the ball/bat impact point all have a relatively negligible effect on the dynamics of the ball/bat collision. Consequently, for the presently preferred embodiment of disclosed technology, the bat handle (16) is shaped to provide a comfortable grip, and the bat (10) label section (20) is shaped as required by the batter or as necessary to optimize other desired bat properties.

While the present subject matter has been described in detail with respect to specific embodiments thereof, it will be appreciated that those skilled in the art, upon attaining an understand of the foregoing may readily produce alterations to, variations of, and equivalents to such embodiments. Accordingly, the scope of the present disclosure is by way of example rather than by way of limitation, and the subject disclosure does not preclude inclusion of such modifications, variations and/or additions to the present subject matter as would be readily apparent to one of ordinary skill in the art.

What is claimed is:

1. A solid laminated blank suitable for machining to form a laminated bat, said laminated blank comprising:

an elongated blank body disposed about a longitudinally extending axis, said blank body having an outer surface defined by the exterior outline of the blank, said blank body composed of a plurality of blank portions;

a first plurality of thin strips, each thin strip defining a pair of opposed faces, each said face defining a substantially flat plane, each said plane being substantially parallel to the other, each said strip further defining a peripheral edge connecting said opposed faces, at least one face of one of said strips being bonded to a face of an adjacently disposed strip, said first plurality of bonded together strips defining a first portion of the blank;

a second plurality of thin strips, each thin strip defining a pair of opposed faces, each said face defining a substantially flat plane, each said plane being substantially parallel to the other, each said strip further defining a peripheral edge connecting said opposed faces, at least one face of one of said strips being bonded to a face of an adjacently disposed strip, said second plurality of bonded together strips defining a second portion of the blank;

wherein at least one thin strip of said first plurality of thin strips is composed of a first material;

wherein at least one thin strip of said second plurality of thin strips is composed of a second material;

wherein the density of the first portion of the blank differs from the density of the second portion of the blank;

wherein at least one of the length of the first portion of the blank and the width of the first portion of the blank is different from that of the second portion of the blank creating size delta value;

wherein the density of said first portion, the density of said second portion, the location of said first portion, the location of said second portion, and the size delta value are selected to provide for a blank having a predefined weight distribution; and wherein said first plurality of thin strips and said second plurality of thin strips are disposed apart from one another along the width of the blank.

2. A solid laminated blank as in claim 1, wherein the density of said first portion of the blank is substantially uniform and wherein the density of said second portion of the blank is substantially uniform.

3. A solid laminated blank as in claim 1, wherein each of said first plurality of thin strips has a thickness defined as the shortest distance between said opposed faces and wherein said thickness is between about $1/32^{nd}$ of an inch to about $1/12^{th}$ of an inch.

4. A solid laminated blank as in claim 3, wherein at least two thin strips of said second plurality of thin strips have a different thickness.

5. A solid laminated blank as in claim 1, wherein each of said second plurality of thin strips has a thickness defined as the shortest distance between said opposed faces and wherein said thickness is between about $1/32^{nd}$ of an inch to about $1/12^{th}$ of an inch.

6. A solid laminated blank as in claim 5, wherein at least two thin strips of said first plurality of thin strips have a different thickness.

7. A solid laminated blank as in claim 1, wherein each of said opposed faces are bonded together by one of an urea resin formulated with a powdered catalyst and a type 1 waterproof glue formulated with a powdered catalyst.

8. A solid laminated blank as in claim 1, wherein said first material is composed of a cellulosic material, such cellulosic material being selected from the group consisting of: maple, mahogany, ash, cherry, poplar, gum, tupelo and pine.

9. A solid laminated blank as in claim 1, wherein at least one thin strip of said first plurality of thin strips is composed of a composite material.

10. A laminated blank having a predetermined exterior outline suitable for machining into a laminated body having a predefined weight distribution wherein said laminated body is used for striking a ball, said laminated blank comprising:

an elongated blank body symmetrically disposed about a longitudinally extending axis and comprising a plurality of laminated blocks including a first, second and third block;

wherein said first laminated block is composed of a first plurality of thin strips, each said thin strip defining a pair of opposed faces, each said face defining a substantially flat plane, each said plane being substantially parallel to the other plane, each said thin strip further defining a peripheral edge connecting said opposed faces and defining a section of the exterior outline of the block, at least one face of one of said thin strips being bonded to a opposed face of an adjacently disposed thin strip such that the peripheral edges of said pair of adjacently disposed and bonded thin strips form an uninterrupted exterior outline of the block, said first block defining a first portion of the blank;

wherein said second laminated block is composed of a second plurality of thin strips, each said thin strip defining a pair of opposed faces, each said face defining a substantially flat plane, each said plane being substantially parallel to the other plane, each said thin strip further defining a peripheral edge connecting said opposed faces and defining a section of the exterior outline of the block, at least one face of one of said thin strips being bonded to an opposed face of an adjacently disposed thin strip such that the peripheral edges of said pair of adjacently disposed and bonded thin strips form an uninterrupted exterior outline of the block, said second plurality of bonded together thin strips defining a second portion of the blank;

wherein said third block is composed of a third plurality of thin strips, each said thin strip defining a pair of opposed faces, each said face defining a substantially flat plane, each said plane being substantially parallel to the other plane, each said thin strip farther defining a peripheral edge connecting said opposed faces and defining a section of the exterior outline of the block, at least one face of one of said thin strips being bonded to a face of an adjacently disposed thin strip such that the peripheral edges of said pair of adjacently disposed and bonded thin strips form a third section of the uninterrupted exterior outline of the blank, said third plurality of bonded together strips defining a third portion of the blank;

wherein at least one thin strip of said first plurality of thin strips is composed of a first material and wherein at least one thin strip of said second plurality of thin strips is composed of a second material;

wherein the density of the first material differs from the density of the second material; and wherein the length of the first block differs from the length of the second block thereby defining a length delta;

wherein said first plurality of thin strips and said second plurality of thin strips are disposed apart from one another; and wherein said first block and said second block are disposed apart from one another along the width of the blank.

11. A laminated blank having a predetermined exterior as in claim 10, wherein the density of said first block, the density of said second block, the density of said third block, the location of said first block, the location of said second block, the location of said third block, and the length delta are selected to provide for a laminated blank having a center of mass located at a predefined point along said longitudinally extending axis.

12. A laminated blank having a predetermined exterior as in claim 10, wherein each of said first plurality of thin strips has a thickness defined as the shortest distance between said opposed faces and wherein said thickness is between about $1/32^{nd}$ of an inch to about 1/12of an inch.

13. A laminated blank having a predetermined exterior as in claim 10, wherein each of said third plurality of thin strips has a thickness defined as the shortest distance between said opposed faces and wherein said thickness is between about 0.00787 inches to about 0.375 inches.

14. A laminated blank suitable for machining into a laminated body suitable for striking a ball, said laminated blank comprising:

an elongated blank body symmetrically disposed about a longitudinally extending axis and comprising a plurality of blocks including a first block, a second block and a third block;

wherein said first block is composed of a first plurality of thin strips, each said thin strip defining a pair of opposed faces, each said face defining a substantially flat plane, each said plane being substantially parallel to the other plane, each said thin strip further defining a peripheral edge connecting said opposed faces and defining a section of the exterior outline of the block, at least one face of one of said thin strips being bonded to a opposed face of an adjacently disposed thin strip such that the peripheral edges of said pair of adjacently disposed and bonded thin strips form an uninterrupted exterior outline of the block, said first block defining a first portion of the blank;

wherein said second laminated block is composed of a second plurality of thin strips, each said thin strip defining a pair of opposed faces, each said face defining a substantially flat plane, each said plane being substantially parallel to the other plane, each said thin strip further defining a peripheral edge connecting said opposed faces and defining a section of the exterior outline of the block, at least one face of one of said thin strips being bonded to an opposed face of an adjacently disposed thin strip such that the peripheral edges of said pair of adjacently disposed and bonded thin strips form an uninterrupted exterior outline of the block, said second plurality of bonded together thin strips defining a second portion of the blank;

wherein at least one thin strip of said first plurality of thin strips is composed of a first material and wherein at least one thin strip of said second plurality of thin strips is composed of a second material;

wherein the density of the first material differs from the density of the second material;

wherein at least one of (a) the length of the first block differs from the length of the second block and (b) the width of the first block differs from the width of the second block thereby defining a size delta;

wherein said first block and said second block are disposed apart from one another; and wherein said first block and said second block are at least partly in alignment along the width of the blank.

15. A laminated blank suitable for machining into a laminated body as in claim 14, wherein at least one of said first block and said second block is about one third the size of the blank.

* * * * *